US010585397B2

(12) United States Patent
Monferrer et al.

(10) Patent No.: US 10,585,397 B2
(45) Date of Patent: Mar. 10, 2020

(54) MECHANISM FOR WINDING A TIMEPIECE

(71) Applicant: Montres Jaquet Droz SA, La Chaux-de-Fonds (CH)

(72) Inventors: Bernat Monferrer, St-Prex (CH); Edmond Capt, Le Brassus (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 157 days.

(21) Appl. No.: 15/920,767

(22) Filed: Mar. 14, 2018

(65) Prior Publication Data

US 2018/0267470 A1 Sep. 20, 2018

(30) Foreign Application Priority Data

Mar. 17, 2017 (EP) ..... 17161686

(51) Int. Cl.

| | |
|---|---|
| ***G04B 3/04*** | (2006.01) |
| ***G04B 3/00*** | (2006.01) |
| ***G04B 27/02*** | (2006.01) |
| ***G04B 27/04*** | (2006.01) |

(52) U.S. Cl.

CPC ..... *G04B 3/04* (2013.01); *G04B 3/006* (2013.01); *G04B 27/026* (2013.01); *G04B 27/04* (2013.01)

(58) Field of Classification Search

CPC ..... G04B 3/04; G04B 27/04; G04B 37/062; G04B 3/006; G04B 27/026

USPC ..... 368/206, 190

See application file for complete search history.

(56) References Cited

U.S. PATENT DOCUMENTS 3,668,864 A * 6/1972 Miyasaka ..... G04B 19/25 368/31
3,866,408 A * 2/1975 Gerber ..... G04B 27/005 368/195
4,392,748 A * 7/1983 Yoshino ..... G04C 9/00 368/157

(Continued)

FOREIGN PATENT DOCUMENTS

CH 35121 7/1906
CH 47977 9/1910

(Continued)

OTHER PUBLICATIONS

European Search Report dated Aug. 31, 2017, issued in European Application EP 17161686.5, filed Mar. 17, 2017 (with English Translation of Categories of Cited References).

*Primary Examiner* — Edwin A. Leon
(74) *Attorney, Agent, or Firm* — Oblon, McClelland, Maier & Neustadt, L.L.P.

(57) ABSTRACT

A mechanism for winding a timepiece including at least first and second energy accumulators, the winding mechanism including a winding stem, a winding pinion and a sliding pinion having face gear toothings, arranged to allow the winding pinion to be driven by the sliding pinion in both directions of rotation of the winding stem, the winding stem and the sliding pinion occupying the same axial winding position. The winding stem is housed inside a bottom plate so that the winding pinion is operational on either side of the winding stem with respect to the bottom plate and the winding mechanism includes first and second coupling/uncoupling devices arranged on either side of the winding stem with respect to the bottom plate.

9 Claims, 5 Drawing Sheets

(56) References Cited

U.S. PATENT DOCUMENTS 7,823,476 B2 * 11/2010 Chaignat ..... F16H 1/003
368/145

FOREIGN PATENT DOCUMENTS

| | | |
|---|---|---|
| CH | 330202 | 5/1958 |
| CH | 708 340 A2 | 1/2015 |

* cited by examiner

MECHANISM FOR WINDING A TIMEPIECE

This application claims priority from European patent application No. 17161686.5 filed on Mar. 17, 2017, the entire disclosure of which is hereby incorporated herein by reference.

FIELD OF THE INVENTION

The invention relates to a mechanism for winding a timepiece comprising at least a first energy accumulator arranged to power a first mechanism, and a second energy accumulator arranged to power a second mechanism, said winding mechanism comprising a winding stem, a winding pinion and a sliding pinion, carried by said winding stem and having face gear (or dog clutch) toothings, facing one another, arranged to allow the winding pinion to be driven by the sliding pinion in both directions of rotation of the winding stem, said winding stem and the sliding pinion occupying the same axial winding position. The invention also relates to a timepiece comprising such a winding mechanism.

BACKGROUND OF THE INVENTION

A winding mechanism of this type is described, for example, in Patent No CH 330202. This document discloses an alarm watch comprising a first energy accumulator formed by the barrel of the movement and a second energy accumulator formed by the barrel of the striking mechanism. The mechanism comprises a winding stem arranged to control all the operations of the movement and the alarm mechanism, and particularly the setting of the movement and of the striking mechanism, but also the winding of the movement barrel or of the striking mechanism barrel by rotating the winding stem in one direction or the other when it occupies its median winding position. To this end, the sliding pinion is meshed with the winding pinion via face gear teeth, and there is provided a crown wheel meshed with the winding pinion, and two intermediate crown wheels, both meshing with the crown wheel and intended to cooperate respectively with the ratchet of each of the barrels. The gearing of the intermediate crown wheels with the corresponding barrel ratchet is ensured by a spring that acts on the arbors of the intermediate crown wheels to push them into mesh with the corresponding ratchet. When the winding stem is rotated in one direction or in the other, by the tangential force exerted by the crown wheel on the intermediate wheels, one of the intermediate crown wheels winds the corresponding barrel whereas the other performs the unclicking operation. Unclicking entails a persistently weak, cyclical contact. Such a mechanism is fragile, owing to the permanent stress of the spring to ensure that the intermediate crown wheels mesh satisfactorily with the corresponding ratchet. Any loss in efficiency of the spring, due to fatigue or ageing, entails the risk that one or other of the intermediate wheels will no longer cooperate with the corresponding ratchet and the associated barrel will no longer be able to be wound. Another drawback is wear of the intermediate crown wheels during the unclicking operation. Moreover, this design requires checking the manufacturing tolerances of the spring.

Patent No CH 47977 also discloses a mechanism for winding and setting an alarm watch with two barrels. This mechanism comprises a winding ratchet for the movement barrel that is constantly engaged with a crown wheel meshing with a winding pinion and disposed to actuate the barrel arbor of the movement in only one direction of rotation of the stem. The winding ratchet of the movement barrel is used to transmit the reverse rotational movement of the stem, either to the winding ratchet of the alarm barrel, or to the alarm wheel, via an intermediate wheel pivoted on a lever operable from outside the watch. This mechanism has the drawback of requiring actuation of an external control member in addition to rotation of the winding stem in order to wind the striking barrel.

SUMMARY OF THE INVENTION

It is an object of the invention to overcome the various drawbacks of known devices.

More specifically, it is an object of the invention to provide a winding mechanism for winding two energy accumulators simply by rotating the winding stem in two directions.

It is also an object of the invention to provide a winding mechanism for winding two energy accumulators, which is highly precise and reliable over time.

It is also an object of the invention to provide a winding mechanism for winding two energy accumulators offering great flexibility in the choice of positioning of the various elements of the mechanism, and in the choice of winding direction of the energy accumulators.

To this end, the present invention concerns a winding mechanism for a timepiece comprising at least a first energy accumulator arranged to power a first mechanism and a second energy accumulator arranged to power a second mechanism, said winding mechanism comprising a winding stem, a winding pinion and a sliding pinion, which are carried by said winding stem and have face gear toothings, facing one another, arranged to allow the winding pinion to be driven by the sliding pinion in both directions of rotation of the winding stem, said winding stem and sliding pinion occupying the same axial winding position.

According to the invention, said winding stem is housed inside a bottom plate, so that the winding pinion is operational on either side of the winding stem with respect to the bottom plate, and the winding mechanism comprises first and second coupling/uncoupling devices arranged on either side of the winding stem with respect to the bottom plate, cooperating with the winding pinion and arranged such that one of the first and second coupling/uncoupling devices occupies a coupling position for coupling the winding pinion and the first energy accumulator, while the other of the first and second coupling/uncoupling devices occupies an uncoupling position for uncoupling the second energy accumulator when the winding stem is rotated in one direction, and occupies an uncoupling position for uncoupling the first energy accumulator, while the other of the first and second coupling/uncoupling devices occupies a coupling position for coupling the winding pinion and the second energy accumulator when the winding stem is rotated in the other direction.

Thus, the winding mechanism according to the invention can wind two energy accumulators simply by rotating the winding stem in one and the other direction.

Further, each energy accumulator is wound by means of its own coupling/uncoupling device, which ensures improved reliability of the winding mechanism. Uncoupling means a total absence of contact and thus eliminates any risk of wear, unlike unclicking.

The winding mechanism according to the invention is particularly suitable for winding a movement barrel forming one of the energy accumulators and for winding a barrel of an independent automaton forming the other energy accumulator.

The present invention also concerns a timepiece comprising a winding mechanism as defined above.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF A PREFERRED EMBODIMENT

The present invention concerns a winding mechanism for at least two energy accumulators provided in a timepiece. These two accumulators can be independent of each other or linked, for example as regards discharging their energy. More particularly, in the following description, the two energy accumulators are independent or autonomous, one of the energy accumulators being a movement barrel powering the main movement of the timepiece and the other energy accumulator being an automaton barrel powering an automaton provided in the timepiece. It is evident that the energy accumulators can be used to power any other timepiece mechanism, for example a striking work, independent seconds or alarm mechanism, or any other suitable mechanism.

In the example described below, the first energy accumulator is the movement barrel and the second energy accumulator is the automaton barrel. It is, however, evident that the roles can be reversed, since the epithet "first" or "second" respectively attributed in the present description to the movement barrel and automaton barrel, is not limiting.

Figure 1:
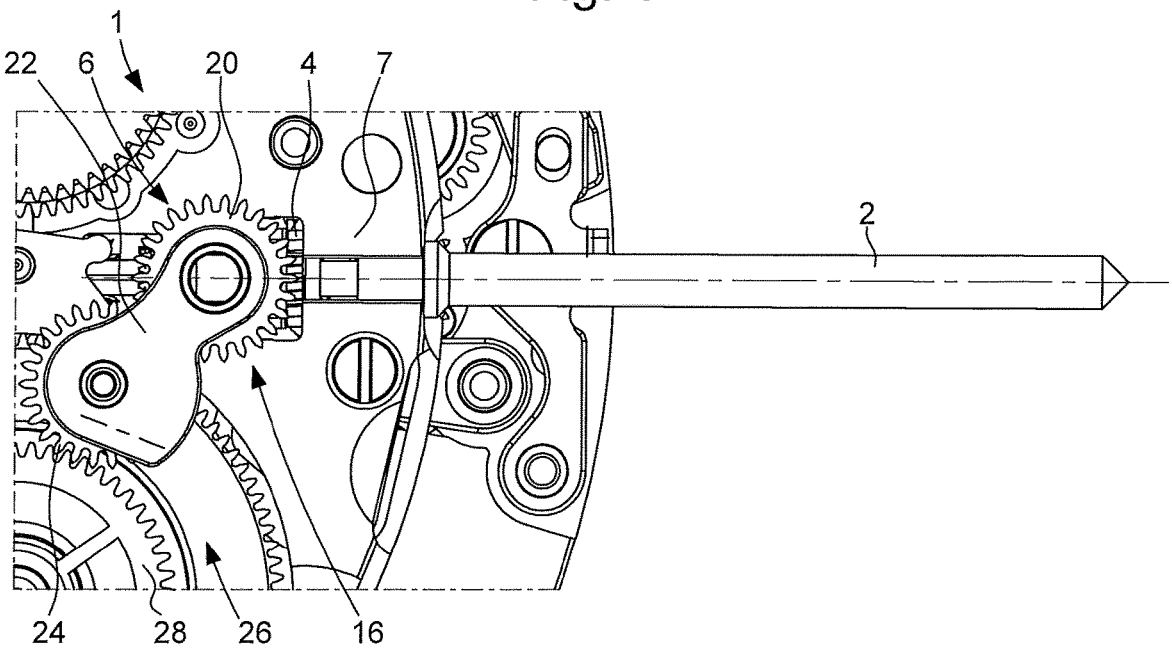
FIG. 1 is a top view, on the movement side, of the winding mechanism according to the invention.
Figure 2:
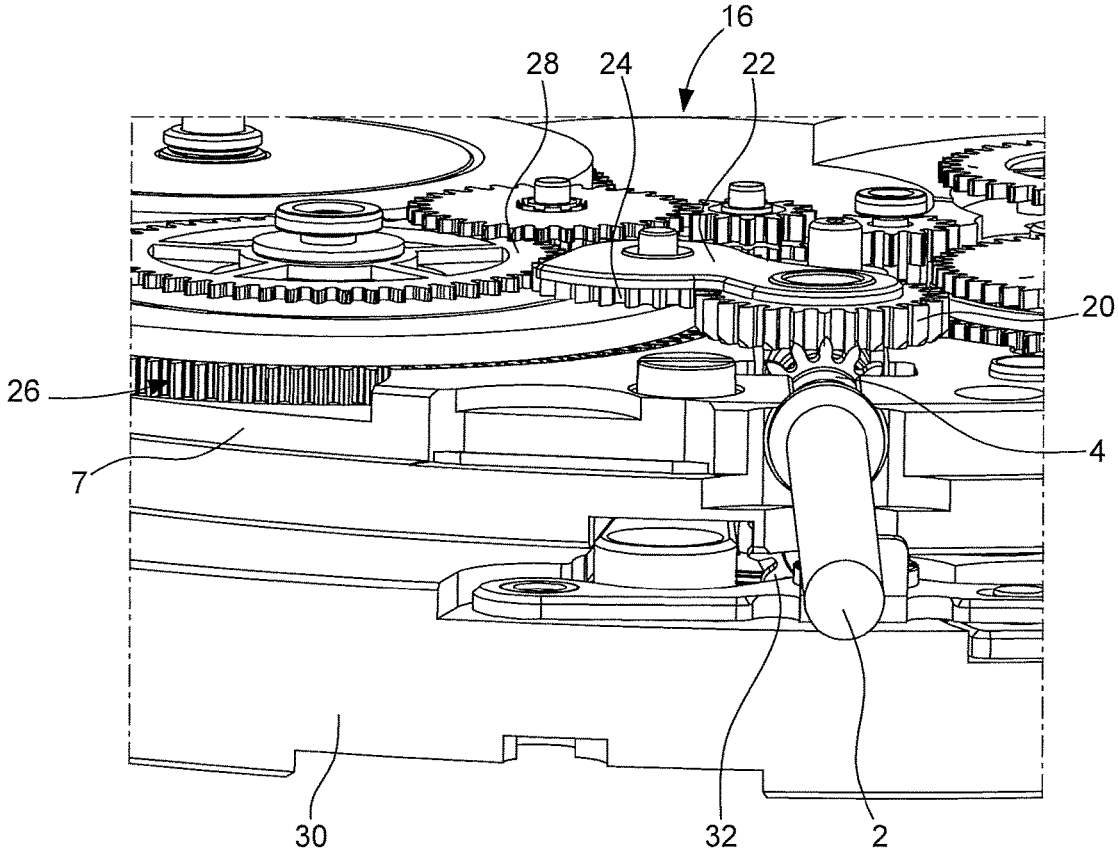
FIG. 2 is a perspective view, on the movement side, of the winding device according to the invention.

Referring to FIG. 1, there is represented a winding mechanism 1 for a timepiece which comprises, in a conventional manner, a winding stem 2, on which are mounted a winding pinion 4 and a sliding pinion 6. Winding stem 2 is housed in a bottom plate 7 and is arranged to occupy at least two axial positions, namely a first winding position, wherein rotation of the winding stem in one direction (clockwise here) winds the movement barrel, and rotation of the winding stem in the other direction (anticlockwise here) winds the automaton barrel, as will be seen below, and a second setting position, wherein rotation of the winding stem in both the clockwise and anticlockwise direction allows the movement to be set, neither the first nor the second energy accumulators can then be wound, regardless of the direction of rotation of the winding stem. In a manner known to those skilled in the art, winding pinion 4 is mounted for free rotation on a cylindrical portion of winding stem 2. Sliding pinion 6 has a square hole and is slidably mounted on a corresponding square provided at the end of winding stem 2. Sliding pinion 6 can thus slide between the winding position, wherein it meshes with winding pinion 4, and the setting position, wherein sliding pinion 6 is separated from winding pinion 4 and meshes with the setting mechanism. Displacement of sliding pinion 6 is achieved by means of a mechanism comprising a pull-out piece and a lever. These elements and mechanisms are known to those skilled in the art and do not require a more detailed description.

It will be noted, however, that unlike conventional winding mechanisms, the sliding pinion and the winding pinion do not engage via a Breguet toothing, but have straight contrate toothings, which face one another, and are arranged to allow winding pinion 4 to be driven by sliding pinion 6 in both the clockwise and anticlockwise directions of rotation of winding stem 2, said winding stem 2 and sliding pinion 6 occupying the same axial winding position.

Figure 11:
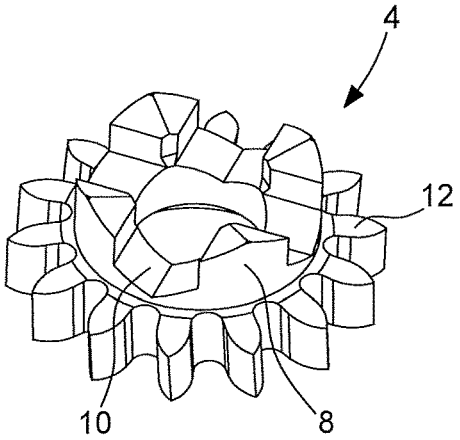
FIG. 11 is a perspective view of the winding pinion.
Figure 12:
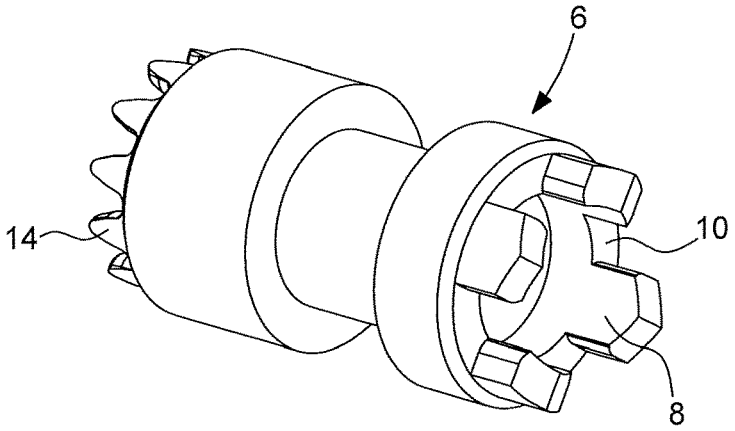
FIG. 12 is a perspective view of the sliding pinion.
Figure 13:
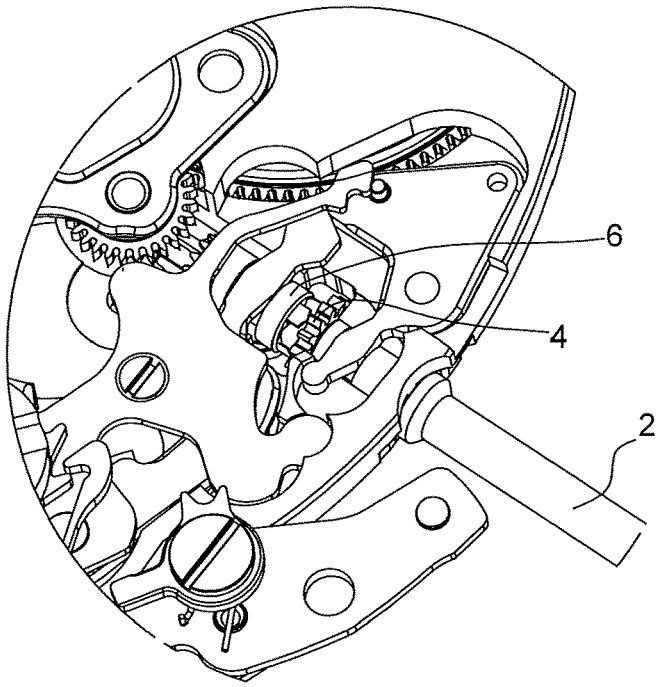
FIG. 13 is a perspective view, on the automaton side, of the sliding pinion and the winding pinion in the winding position.

Referring more particularly to FIGS. 11 to 13, the straight contrate toothings of sliding pinion 6 and of winding pinion 4 may be face gear or dog clutch teeth. To this end, winding pinion 4 and sliding pinion 6 respectively have, in place of a Breguet toothing, crenelated teeth 8, which end in two inclined faces meeting at the top of the crenelation and alternate with recesses 10 of complementary shape to those of teeth 8, allowing said pinions to mesh by the engagement of teeth 8 of one in the corresponding recesses 10 of the other. This contrate, dog clutch tooth shape allows sliding pinion 6 to fit (in a "dog clutch" coupling) easily into winding pinion 4, and to transmit more torque when they are in the winding position, as shown in FIG. 13. These contrate dog clutch teeth can also be used without much stress. In a manner known per se, winding pinion 4 also comprises a peripheral toothing 12, arranged to cooperate with the first and second coupling/uncoupling devices, as will be explained in detail below. Sliding pinion 6 also comprises a contrate toothing 14, opposite contrate dog clutch toothing 8, arranged to cooperate with the setting mechanism.

According to the invention, and referring to FIGS. 1 to 4, the winding mechanism comprises a first coupling/uncoupling device 16 and a second coupling/uncoupling device 18, disposed on either side of winding stem 2 with respect to bottom plate 7, said first and second coupling/uncoupling devices 16 and 18 each cooperating with winding pinion 4. To this end, winding stem 2 is advantageously housed inside plate 7 such that winding pinion 4 is operational on either side of winding stem 2 with respect to plate 7. This means that winding pinion 4 is disposed inside a housing provided in plate 7 and the members around winding pinion 4 are arranged such that winding pinion 4 can mesh with each of the first and second coupling/uncoupling devices 16 and 18 placed on either side of winding stem 2 with respect to plate 7.

Further, the first and second coupling/uncoupling devices 16 and 18 are arranged so that one of the first and second coupling/uncoupling devices 16, 18:

occupies a coupling position for coupling winding pinion 4 and the first energy accumulator, while the other of the first and second coupling/uncoupling devices 16, 18 occupies an uncoupling position for uncoupling the second energy accumulator when winding stem 2 is rotated in one direction, and occupies an uncoupling position for uncoupling the first energy accumulator, while the other of the first and second coupling/uncoupling devices 16, 18 occupies a coupling position for coupling winding pinion 4 and the second energy accumulator when winding stem 2 is rotated in the other direction.

According to the invention, one of the first and second coupling/uncoupling devices 16, 18, in this case, randomly, first coupling/uncoupling device 16, comprises a first crown wheel 20 which cooperates with peripheral toothing 12 of winding pinion 4 and on which is mounted a first coupling lever 22. Said first coupling lever 22 carries, at its free end, a first drive pinion 24 arranged to be able to kinematically connect first crown wheel 20 to first energy accumulator 26, which is the movement barrel here. More particularly, first drive pinion 24 is positioned on first coupling lever 22 and arranged, on the one hand, to mesh with first crown wheel 20, and on the other hand, to be capable of meshing with a first ratchet 28 cooperating with first energy accumulator 26. It is evident that, in another variant (not represented), wherein the winding of the movement barrel occurs via the drum in order to rotate the barrel in the opposite direction, the first drive pinion will then be arranged to mesh with the drum of said barrel.

Said first coupling lever 22 is freely mounted on the arbor of said first crown wheel 20 and first drive pinion 24 is friction mounted on said first coupling lever 22, such that, while first coupling device 16 is not occupying its coupling position, said first coupling lever 22 and first drive pinion 24 pivot integrally with said first crown wheel 20 to move:

into the coupling position to kinematically connect first drive pinion 24 to first ratchet 28 of first energy accumulator 26 and then, once first drive pinion 24 is in contact with first ratchet 28 of first energy accumulator 26, first coupling lever 22 is prevented from continuing to pivot and first drive pinion 24 detaches from first coupling lever 22 as a result of friction, thereby allowing first drive pinion 24 to be driven by winding pinion 4 via first crown wheel 20 to wind first energy accumulator 26 when winding stem 2 is rotated in a first direction, for example clockwise, into an uncoupling position by moving first drive pinion 24 away from first energy accumulator 26 when winding stem 2 is rotated in a second, opposite direction, in this case anticlockwise.

In the example disclosed here, first coupling/uncoupling device 16 is disposed on the movement side for winding the movement barrel.

Figure 3:
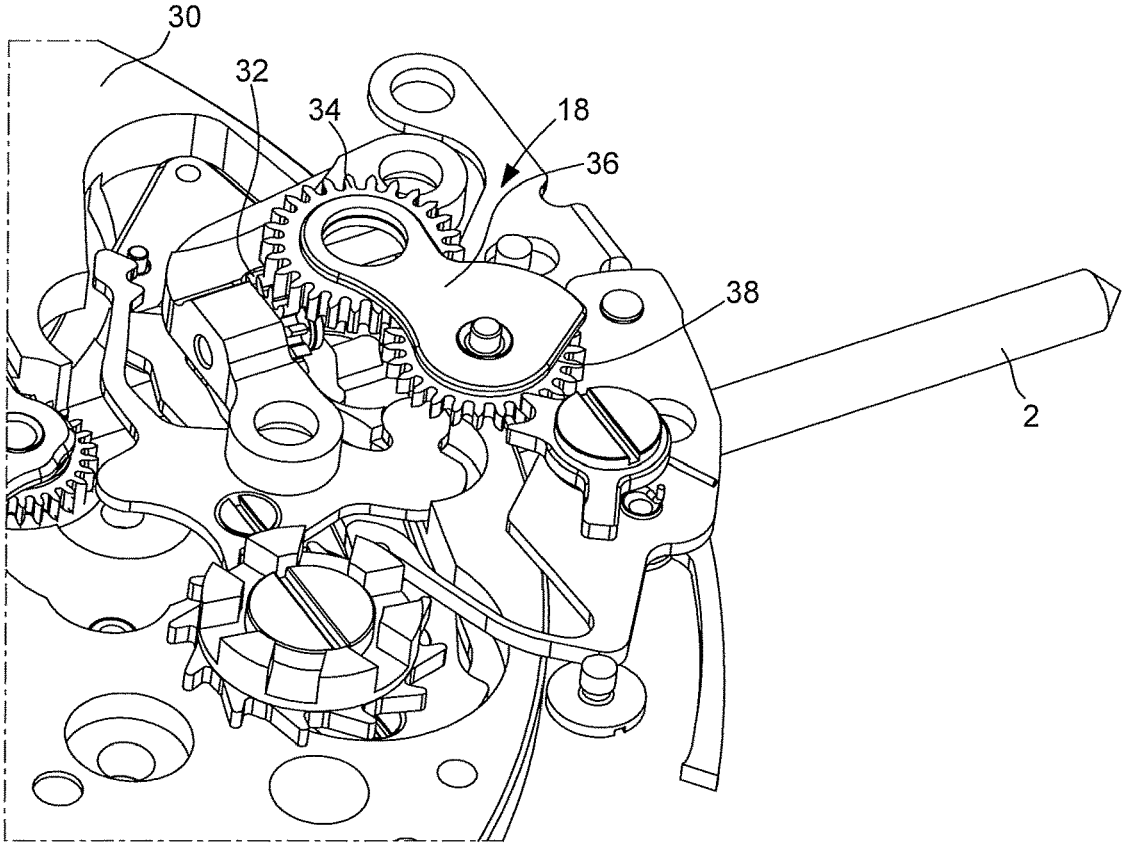
FIG. 3 is a perspective view, on the automaton side, of the winding device according to the invention.
Figure 4:
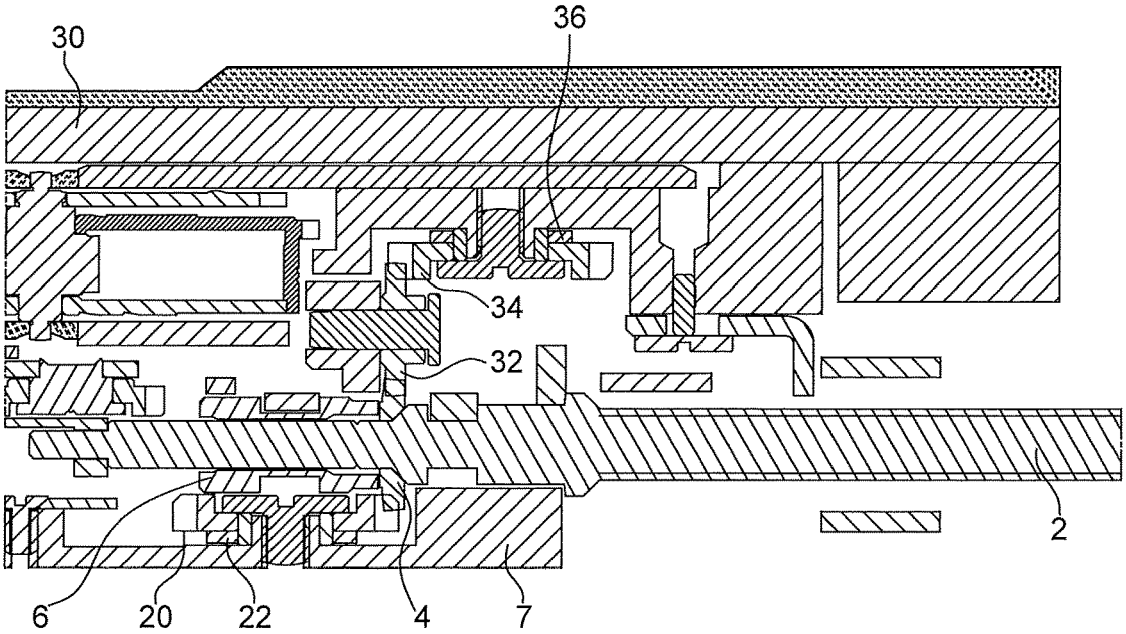
FIG. 4 is a cross-section of the winding mechanism along the winding stem.

On the other side of bottom plate 7, opposite to the movement, there is arranged a plate 30 on which are mounted the elements of the automaton mechanism, and, in particular, second energy accumulator 27, which is the automaton barrel here, and the other of first and second coupling/uncoupling devices 16, 18, which is second coupling/uncoupling device 18 here, as shown in FIG. 3. Thus, in the variant represented, the first and second energy accumulators are arranged on either side of winding stem 2 with respect to bottom plate 7. It is evident that in a variant that is not represented, the first and second energy accumulators may be disposed on the same side, intermediate wheel sets then being used to kinematically connect each coupling/uncoupling device to its associated energy accumulator.

Second coupling/uncoupling device 18 comprises an intermediate winding pinion 32 mounted on the frame of the movement and cooperating with peripheral toothing 12 of winding pinion 4, which is arranged so that its peripheral toothing 12 is also accessible and operational from this side of the timepiece, i.e. on the plate side or automaton side. Second coupling/uncoupling device 18 also comprises a second crown wheel 34 cooperating with winding pinion 4, via intermediate winding pinion 32, and on which is mounted a second coupling lever 36. Said second coupling lever 36 carries, at its free end, a second drive pinion 38 arranged to be able to kinematically connect second crown wheel 34 to second energy accumulator 27, which is the automaton barrel here. More particularly, second drive pinion 38 is positioned on second coupling lever 36 and arranged, on the one hand, to mesh with second crown wheel 34, and on the other hand, to be capable of meshing with a second ratchet 40 that cooperates with second energy accumulator 27. It is evident that, in another variant (not represented), wherein the winding of the automaton barrel occurs via the drum in order to rotate the barrel in the opposite direction, the first drive pinion will then be arranged to mesh with the drum of said barrel.

In the example described here, the first and second energy accumulators 26, 27 are wound by their respective ratchet, anti-reverse mechanisms (not represented) such as a click, spring or jumper, known to those skilled in the art, being provided on the ratchet to prevent the ratchet from going back.

Said second coupling lever 36 is freely mounted on the arbor of second crown wheel 34 and second drive pinion 38 is friction mounted on said second coupling lever 36, so that while second coupling device 18 is not occupying its coupling position, said second coupling lever 36 and second drive pinion 38 pivot integrally with said second crown wheel 34 to move:

into the coupling position to kinematically connect second drive pinion 38 to second ratchet 40 of second energy accumulator 27 and then, once second drive pinion 38 is in contact with second ratchet 40 of second energy accumulator 27, second coupling lever 36 is prevented from continuing to pivot and second drive pinion 38 detaches from second coupling lever 36 as a result of friction, thereby allowing second drive pinion 38 to be driven by winding pinion 4 via intermediate winding pinion 32 and second crown wheel 34 to wind second energy accumulator 27 when winding stem 2 is rotated in the second direction, namely the anticlockwise direction here, into an uncoupling position by moving second drive pinion 38 away from second energy accumulator 27 when winding stem 2 is rotated in the first direction, namely, in this case, clockwise.

It is evident that the directions of rotation of the winding stem described here are not limiting, and that they can be reversed, the first energy accumulator could be wound by rotating the winding stem in the anticlockwise direction, the second energy accumulator would then be wound by rotating the winding stem in the clockwise direction.

Moreover, it is noted that the use of an intermediate winding pinion is optional and could be adapted by those skilled in the art as a function, for example, of the positioning and direction of rotation of the other components of the structure, and particularly, for example, as a function of the directions of rotation of the barrels. If the barrels need to have opposite directions of operation, those skilled in the art know how to arrange their components (drum, spring, arbor) accordingly.

Figure 5:
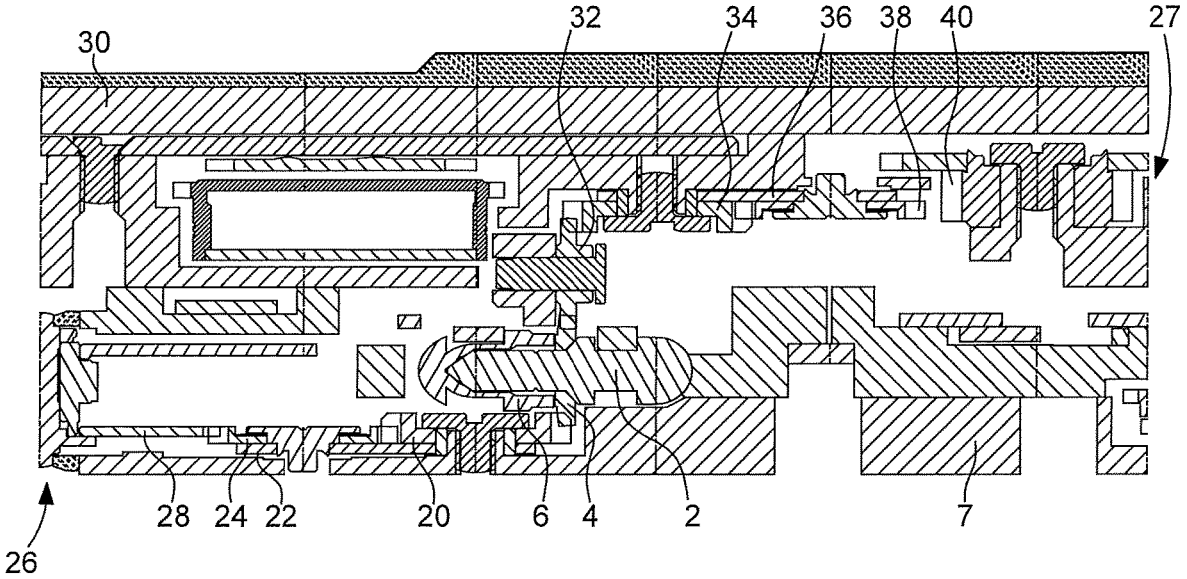
FIG. 5 is an open cross-sectional view of the winding mechanism through the gears concerned when the movement barrel is driven, and the automaton barrel is uncoupled.
Figure 6:
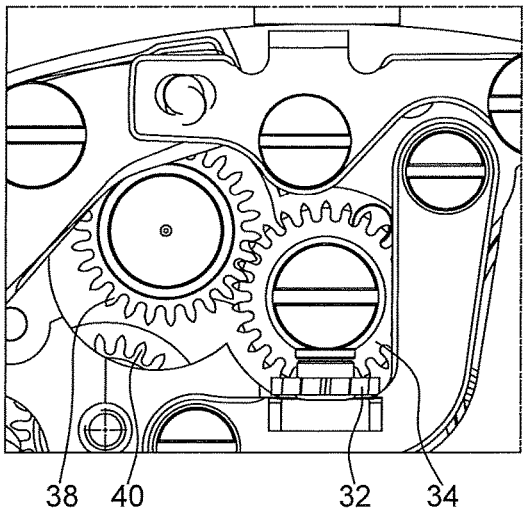
FIG. 6 is a view of the coupling/uncoupling device, on the automaton side, in the uncoupled position.
Figure 7:
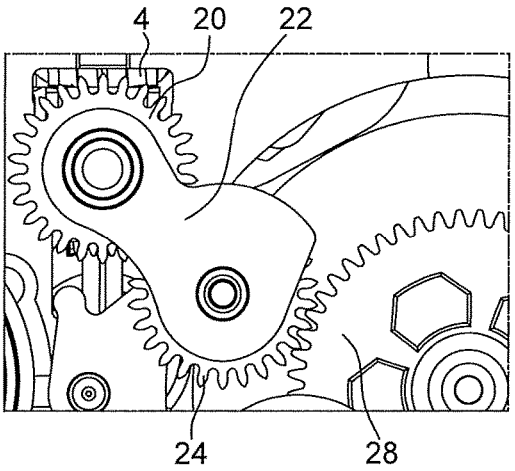
FIG. 7 is a view of the coupling/uncoupling device, on the movement side, in the coupling position.

The operation of the winding mechanism according to the invention is as follows: referring to FIGS. 5 to 7, when it is necessary to wind the movement barrel, winding stem 2 is positioned in its axial winding position so that sliding pinion 6 meshes with winding pinion 4, as shown in FIG. 13, and then winding stem 2 is rotated in the clockwise direction. This rotation of winding stem 2 causes the rotation of winding pinion 4 in the clockwise direction. On the movement side, winding pinion 4 meshes with first crown wheel 20 to pivot it anticlockwise. Since first coupling lever 22 and first drive pinion 24 are connected as a result of friction and the lack of torque transmission through the gears, and first drive pinion 24 is meshed with first crown wheel 20, first coupling lever 22 and first drive pinion 24 pivot integrally with said first crown wheel 20 about its arbor in the anticlockwise direction until first drive pinion 24 enters into contact with first ratchet 28. First coupling/uncoupling device 16 is in the coupling position, as shown in FIGS. 5 and 7. Since first coupling lever 22 is henceforth prevented from pivoting, first drive pinion 24 detaches from first coupling lever 22 as a result of friction, such that the rotation of first crown wheel 20 driven by winding pinion 4 now causes the rotation of first drive pinion 24 which meshes with first ratchet 28 to wind the movement barrel.

At the same time, on the plate or automaton side, the rotation of winding pinion 4 in the clockwise direction causes the rotation of intermediate winding pinion 32 in the anticlockwise direction. This rotation of intermediate winding pinion 32 causes the rotation of second crown wheel 34 in the clockwise direction. Since second coupling lever 36 and second drive pinion 38 are connected as a result of friction and the lack of torque transmission through the gears, and second drive pinion 38 is meshed with second crown wheel 34, second coupling lever 36 and second drive pinion 38 pivot integrally with said second crown wheel 34 about its arbor in the clockwise direction to move said second drive pinion 38 away from second energy accumulator 27, as shown in FIGS. 5 and 6. Second coupling/uncoupling device 18 is then in an uncoupling position, so that second energy accumulator 27 is not wound during the winding of first energy accumulator 26 by the rotation of winding stem 2 in the clockwise direction.

Figure 8:
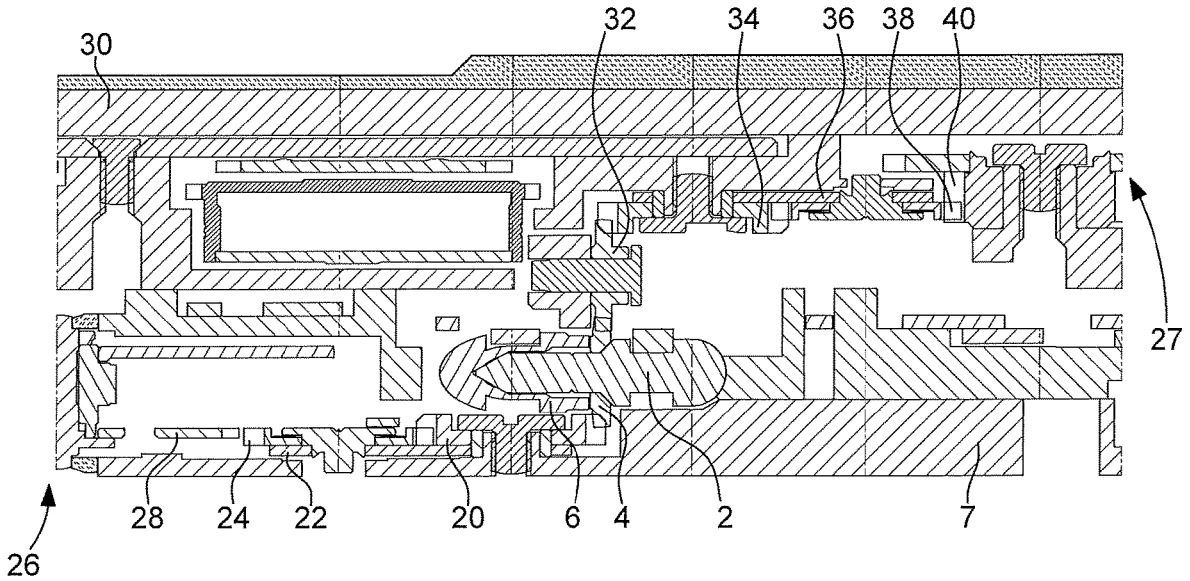
FIG. 8 is n open cross-sectional view of the winding mechanism through the gears concerned when the movement barrel is uncoupled, and the automaton barrel is driven.
Figure 9:
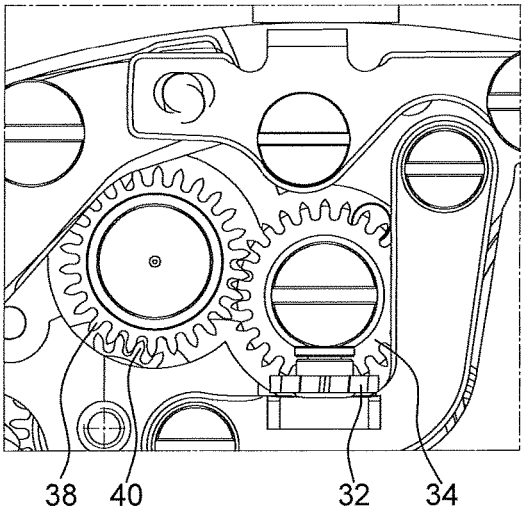
FIG. 9 is a view of the coupling/uncoupling device, on the automaton side, in the coupling position.
Figure 10:
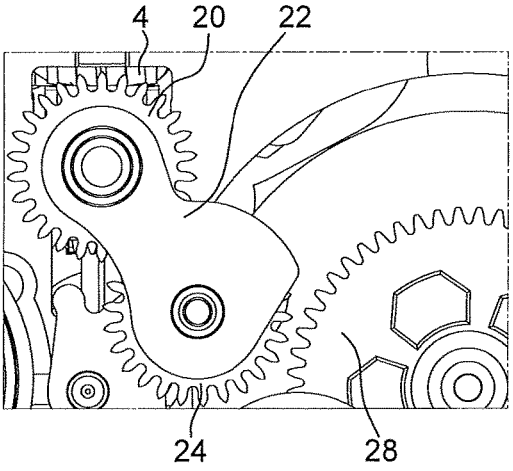
FIG. 10 is a view of the coupling/uncoupling device, on the movement side, in the uncoupling position.

To wind the second energy accumulator, which is the automaton barrel here, referring to FIGS. 8 to 10, winding stem 2 is still positioned in its axial winding position, so that sliding pinion 6, which has not moved, is still in mesh with winding pinion 4, as shown in FIG. 13, and then winding stem 2 is rotated in the anticlockwise direction. This rotation of winding stem 2 causes the rotation of winding stem 4 in the anticlockwise direction. On the plate or automaton side, the rotation of winding pinion 4 in the anticlockwise direction causes the rotation of intermediate winding pinion 32 in the clockwise direction. This rotation of intermediate winding pinion 32 causes the rotation of second crown wheel 34 in the anticlockwise direction. Since second coupling lever 36 and second drive pinion 38 are connected as a result of friction and the lack of torque transmission through the gears, and second drive pinion 38 is meshed with second crown wheel 34, second coupling lever 36 and second drive pinion 38 pivot integrally with said second crown wheel 34 about its arbor in the anticlockwise direction until second drive pinion 38 enters into contact with second ratchet 40. Second coupling/uncoupling device 18 is in the coupling position as shown in FIGS. 8 and 9. Since second coupling lever 36 is henceforth prevented from pivoting, second drive pinion 38 detaches from second coupling lever 36 as a result of friction, such that the rotation of second crown wheel 34 driven by winding pinion 4 and intermediate winding pinion 32 now causes the rotation of second drive pinion 38, which meshes with second ratchet 40 to wind the automaton barrel.

At the same time, on the movement side, winding pinion 4 rotates in the anticlockwise direction and meshes with first crown wheel 20 to pivot it clockwise. Since first coupling lever 22 and first drive pinion 24 are connected as a result of friction and the lack of torque transmission through the gears, and first drive pinion 24 is meshed with first crown wheel 20, first coupling lever 22 and first drive pinion 24 pivot integrally with said first crown wheel 20 about its arbor in the clockwise direction to move said first drive pinion 24 away from first energy accumulator 26, as shown in FIGS. 8 and 10. First coupling/uncoupling device 16 is then in an uncoupling position, so that first energy accumulator 26 is not wound during the winding of second energy accumulator 27 by the rotation of winding stem 2 in the anticlockwise direction.

Thus, the winding mechanism according to the invention allows for precise and reliable winding of two energy accumulators simply by rotating the winding stem in both directions, with the winding stem occupying the same axial winding position.

What is claimed is:

1. A winding mechanism for a timepiece comprising at least a first energy accumulator arranged to power a first mechanism and a second energy accumulator arranged to power a second mechanism, said winding mechanism comprising a winding stem, a winding pinion and a sliding pinion, which are carried by said winding stem and have face gear teeth, facing one another, arranged to allow the winding pinion to be driven by the sliding pinion in both directions of rotation of the winding stem, said winding stem and the sliding pinion occupying a same axial winding position, wherein said winding stem is housed inside a bottom plate, such that the winding pinion is operational on either side of the winding stem with respect to the bottom plate, and wherein the winding mechanism comprises first and second coupling/uncoupling devices disposed on either side of the winding stem with respect to the bottom plate, cooperating with the winding pinion and arranged so that one of said first and second coupling/uncoupling devices occupies a coupling position for coupling the winding pinion and the first energy accumulator, while the other of the first and second coupling/uncoupling devices occupies an uncoupling position for uncoupling the second energy accumulator when the winding stem is rotated in one direction, and occupies an uncoupling position for uncoupling the first energy accumulator, while the other of the first and second coupling/uncoupling devices occupies a coupling position for coupling the winding pinion and the second energy accumulator when the winding stem is rotated in the other direction.

2. The winding mechanism according to claim 1, wherein one of the first and second coupling/uncoupling devices comprises a first crown wheel cooperating with the winding pinion and on which is mounted a first coupling lever carrying a first drive pinion arranged to be capable of kinematically connecting the first crown wheel to the first energy accumulator, said first coupling lever being freely mounted on the first crown wheel and the first drive pinion being friction mounted on said first coupling lever so as to pivot integrally with said first crown wheel in the coupling position to kinematically connect the first drive pinion to the first energy accumulator, and then to allow the first drive pinion to be driven by the first crown wheel to wind the first energy accumulator, when the winding stem is rotated in a first direction, and so as to pivot integrally with the first crown wheel in the uncoupling position to move the first drive pinion away from the first energy accumulator, when the winding stem is rotated in a second, opposite direction.

3. The winding mechanism according to claim 1, wherein the other of the first and second coupling/uncoupling devices comprises a second crown wheel cooperating with the winding pinion and on which is mounted a second coupling lever carrying a second drive pinion arranged to be capable of kinematically connecting the second crown wheel to the second energy accumulator, said second coupling lever being freely mounted on the second crown wheel and the second drive pinion being friction mounted on said second coupling lever, so as to pivot integrally with said second crown wheel in the coupling position to kinematically connect the second drive pinion to the second energy accumulator, and then to allow the second drive pinion to be driven by the second crown wheel to wind the second energy accumulator, when the winding stem is rotated in the second direction, and so as to pivot integrally with the second crown wheel in the uncoupling position to move the second drive pinion away from the second energy accumulator, when the winding stem is rotated in the first direction.

4. The winding mechanism according to claim 1, wherein the face gear teeth of the sliding pinion and of the winding pinion are dog clutch teeth.

5. The winding mechanism according to claim 4, wherein the sliding pinion and the winding pinion respectively have crenelated teeth ending in two inclined faces that meet at the top of the crenellation and alternate with recesses of complementary shape to those of the teeth, allowing said pinions to mesh by the engagement of the teeth of one in the corresponding recesses of the other.

6. The winding mechanism according to claim 2, wherein the first drive pinion is arranged to be capable of meshing, when the first coupling/uncoupling device is in the coupling position, with a first ratchet cooperating with the first energy accumulator.

7. The winding mechanism according to claim 3, wherein the second drive pinion is arranged to be capable of meshing, when the second coupling/uncoupling device is in the coupling position, with a second ratchet cooperating with the second energy accumulator.

8. The winding mechanism according to claim 1, wherein the first and second energy accumulators are disposed on either side of the winding stem with respect to the bottom plate.

9. A timepiece comprising at least a first energy accumulator arranged to power a first mechanism, a second energy accumulator arranged to power a second mechanism, and a winding mechanism comprising a winding stem, a winding pinion and a sliding pinion, which are carried by said winding stem and have face gear teeth, facing one another, arranged to allow the winding pinion to be driven by the sliding pinion in both directions of rotation of the winding stem, said winding stem and the sliding pinion occupying a same axial winding position, wherein said winding stem is housed inside a bottom plate, such that the winding pinion is operational on either side of the winding stem with respect to the bottom plate, and wherein the winding mechanism comprises first and second coupling/uncoupling devices disposed on either side of the winding stem with respect to the bottom plate, cooperating with the winding pinion and arranged so that one of said first and second coupling/uncoupling devices occupies a coupling position for coupling the winding pinion and the first energy accumulator, while the other of the first and second coupling/uncoupling devices occupies an uncoupling position for uncoupling the second energy accumulator when the winding stem is rotated in one direction, and occupies an uncoupling position for uncoupling the first energy accumulator, while the other of the first and second coupling/uncoupling devices occupies a coupling position for coupling the winding pinion and the second energy accumulator when the winding stem is rotated in the other direction.

* * * * *